US005938515A

United States Patent [19]

McLain et al.

[11] Patent Number: 5,938,515

[45] Date of Patent: Aug. 17, 1999

[54] FOAM BUFFING PAD OF STRING-LIKE CONSTRUCTION

[75] Inventors: Scott S. McLain, Wind Lake; Richard A. Kaiser, Hartland; Jim D. Schneider, Pewaukee, all of Wis.

[73] Assignee: Lake Country Manufacturing, Inc., Hartland, Wis.

[21] Appl. No.: 08/980,660

[22] Filed: Dec. 1, 1997

[51] Int. Cl.[6] ..... B24D 11/00

[52] U.S. Cl. ..... 451/528; 451/532; 451/535

[58] Field of Search ..... 15/230.13, 230.14, 15/230.16; 451/527, 528, 529, 532, 535, 536

[56] References Cited

U.S. PATENT DOCUMENTS

| | | | |
|---|---|---|---|
| Re. 35,021 | 8/1995 | Englund et al. . | |
| D. 291,258 | 8/1987 | Greer, Sr. . | |
| 2,214,351 | 9/1940 | Schlegel . | |
| 2,347,244 | 4/1944 | Colt et al. | 451/527 X |
| 2,690,661 | 10/1954 | Briggs . | |
| 2,803,096 | 8/1957 | Mockiewicz . | |
| 2,833,911 | 5/1958 | Mahmarian . | |
| 3,252,775 | 5/1966 | Tocci-Guilbert . | |
| 3,418,675 | 12/1968 | Meguiar et al. . | |
| 3,727,353 | 4/1973 | Pixley . | |
| 3,857,133 | 12/1974 | Linenfelser . | |
| 4,055,029 | 10/1977 | Kalbow . | |
| 4,111,666 | 9/1978 | Kalbow . | |
| 4,407,040 | 10/1983 | Scharf . | |
| 4,485,919 | 12/1984 | Sandel . | |
| 4,523,411 | 6/1985 | Freerks . | |
| 5,007,128 | 4/1991 | Englund et al. . | |
| 5,016,401 | 5/1991 | Mangus et al. | 451/527 X |
| 5,020,283 | 6/1991 | Tuttle . | |
| 5,185,964 | 2/1993 | Englund et al. . | |
| 5,312,197 | 5/1994 | Abramson . | |
| 5,389,032 | 2/1995 | Beardsley . | |
| 5,396,737 | 3/1995 | Englund et al. . | |
| 5,525,100 | 6/1996 | Kelly et al. | 451/527 |
| 5,679,067 | 10/1997 | Johnson et al. | 451/527 |
| 5,771,525 | 6/1998 | Fulcher et al. . | |

FOREIGN PATENT DOCUMENTS

| | | | |
|---|---|---|---|
| 910638 | 9/1972 | Canada | 451/532 |
| 990142 | 4/1965 | United Kingdom . | |

*Primary Examiner*—Timothy V. Eley

*Attorney, Agent, or Firm*—Andrus, Sceales, Starke & Sawall

[57] ABSTRACT

A polymeric foam finishing pad is made by attaching a dense array of individual foam fingers to a suitable backing substrate. The fingers may be individually attached to the substrate or attached to the substrate by an intermediate foam strip to which the fingers are integrally joined. When making a circular rotary buffing pad, the foam strip is preferably attached to the substrate in a spiral pattern.

19 Claims, 3 Drawing Sheets

FOAM BUFFING PAD OF STRING-LIKE CONSTRUCTION

BACKGROUND OF THE INVENTION

The present invention pertains to foam pads for buffing and, more particularly, to rotary pads made from foam string material for buffing and polishing painted or similarly finished surfaces.

Foam buffing pads are now used in many buffing and polishing operations where synthetic or natural fiber pads, such as tufted wool pads, had previously been used. In particular, open cell polyurethane foam pads, with both reticulated and nonreticulated cell structures, have become particularly popular. However, despite certain advantages of polymer foam pads over fibrous and tufted pads, there are still a number of inherent disadvantages attendant the use of foam pads. These disadvantages include "chatter" or jumping of the pad by excess frictional surface contact between flat working surface portions of the pad and the surface of the work being finished; splattering of the polish or other finishing compound as a result of the compound being thrown radially outwardly by centrifugal force; and, burning of the surface of the work being finished by the high speed outer edge portions of the rotary pad.

Attempts have been made to minimize or eliminate these problems by varying the type and density of foam used and by changing the working surface of the pads. Initially, foam pads were made of a generally cylindrical disc with a flat planar working face and, typically, with a radiused outer edge providing the transition between the working face and the outer cylindrical edge face. However, flat pads are particularly subject to chatter and provide little deterrent to the splatter of polish. Flat faced pads also give the operator little control over variations in the working surface actually in contact with the work surface being finished or polished. One attempt at solving the problems presented by flat foam buffing pads was the introduction of buffing pads having working surfaces with a convoluted or waffle shape. One such pad was previously made by Lake Country Manufacturing, Inc. Although this pad provided variable working surface contact by varying operator-applied pressure, surface contact was somewhat difficult to control and the pad did little to prevent splatter. A different approach to solving the prior art problems is shown in U.S. Pat. No. 5,527,215 where a cylindrical foam pad has a recessed center portion or portions within which the polishing compound may be trapped against radial splatter. This pad also provides the ability to alter the working surface contact by varying operator-applied pressure. However, neither of the foregoing pads adequately solves all of the prior art problems.

One recent attempt to solve the remaining problems inherent in foam buffing pads has resulted in the introduction of a pad having a working face comprising a concave central contact surface which increases radially inwardly with increasing pad compression by the operator. This pad has helped reduce chatter and improved operator control of the working surface contact area.

However, all of the foregoing foam pads are characterized by their monolithic body construction in which the foam bodies are made of a single uniform layer of foam material and, as a result, have an uninterrupted working face regardless of variations in face contour. As a result, monolithic polymeric foam pads remain subject to pad chatter, relatively rapid working surface contamination, undesirable swirl marks, and susceptibility to tearing out of large pieces of the foam body as a result of contact with obstructions during the finishing operation.

As a result, foam buffing and finishing pads have never completely replaced pads made with tufted wool fibers or other natural or synthetic fibers. U.S. Pat. No. b 2,690,661shows an attempt to provide a hybrid pad comprising a tufted construction of cotton strands to which an outer layer of cellulose material is intimately bonded. If a pad of this construction was ever commercialized, its use today is not known.

SUMMARY OF THE INVENTION

In accordance with the present invention, a surface finishing pad and its method of manufacture are provided which combine all of the best features of foam pads and tufted pad and, as a result, provide a pad capable of providing a superior finish, substantially extended wear life, superior performance, and substantially extended service time between cleanings.

In one embodiment of the invention, a surface finishing pad includes a supporting substrate, and a plurality of fingers of a polymeric foam material which are disposed in dense array, with the fingers having inner base ends which are attached to the substrate and outer tips which define the pad finishing face. The fingers may be integrally joined to an elongate foam body, and the elongate body secured along substantially its full length to the substrate.

In a preferred embodiment for use as a rotary finishing pad, the substrate is circular and the polymeric foam body is secured to the substrate along a spiral connecting line which extends between an outer edge of the substrate and a central region thereof. The connecting line may be sewn, glued, or fused.

Individual polymeric foam fingers may also be glued or fused to the substrate to provide the dense array.

The substrate may comprise a wide variety of materials, including woven natural fiber, woven synthetic fiber, plastic impregnated woven fiber, and solid plastics. In one embodiment, the polymeric foam body and integral fingers are made from a thin strip formed with a central body portion that extends generally along the center line of the strip and a plurality of finger portions which extend laterally from the body portion in opposite directions.

The polymeric foam material preferably comprises polyurethane. More preferably, the material is an open cell polyurethane which may or may not be reticulated. The outer tips of the fingers may be loaded with an abrasive material, such as abrasive particles. The abrasive particles may be adhesively attached to the fingers or may be incorporated directly into the foam material.

In a presently preferred embodiment of the subject invention, a surface finishing pad comprises a supporting substrate, a strip of polymeric foam material which has an elongated body and a plurality of fingers extending from the body, and means for attaching the body of the strip to the substrate along a substantially continuous seam to define laterally adjacent body portions and a finishing face which is comprised of the tips of the fingers. Preferably, the substrate is generally circular in shape and the seam is in the form of a spiral. This substantially continuous seam may be sewn, glued, or fused.

One embodiment of a method for manufacturing a surface finishing pad, in accordance with the present invention, includes the steps of (1) providing a circular supporting substrate, (2) forming a strip of polymeric foam material with an elongate body and a plurality of laterally extending figures, and (3) attaching the strip to the substrate with a substantially continuous spiral seam. A variant method includes the steps of (1) providing a supporting substrate, (2) forming a plurality of fingers of a polymeric foam material, and (3) attaching the fingers to the substrate to form a densely packed array of fingers. The fingers may be attached by sewing, gluing or fusing.

A further variation of the method comprises the steps of (1) providing a generally circular supporting substrate, (2) attaching a layer of a polymeric foam material by a rear face to the substrate and leaving an exposed front face, and (3) cutting the front face to form an array of fingers having tips disposed over the front face and extending inwardly toward the rear face. The cutting step preferably comprises slitting the layer on two series of orthogonally disposed slits to define a dense array of the fingers. In a preferred embodiment, the cutting step comprises extending the slits completely through the layer to the substrate.

DETAILED DESCRIPTION OF THE PREFERRED EMBODIMENTS

Figure 1:
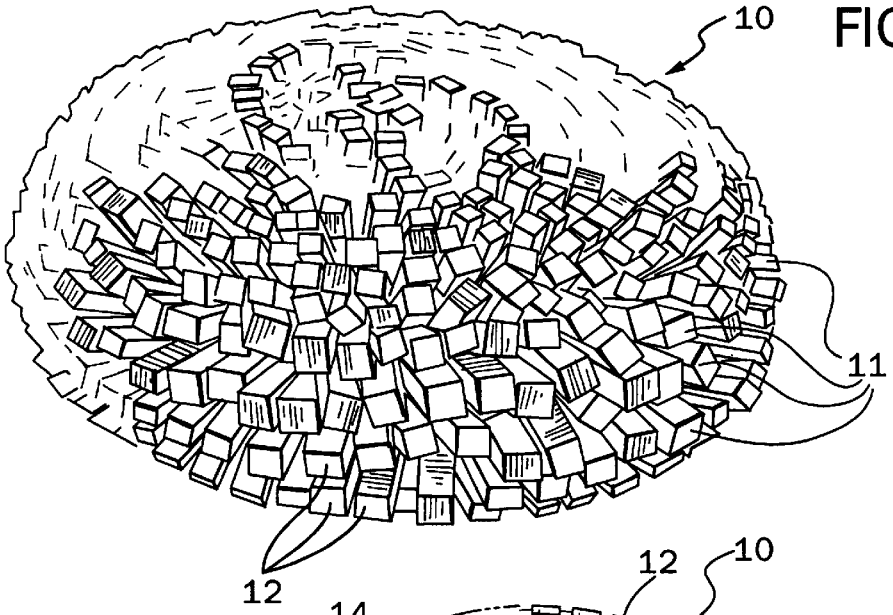
FIG. 1 is a top perspective view of a surface finishing pad of the present invention made in accordance with the method of the preferred embodiment.
Figure 2:
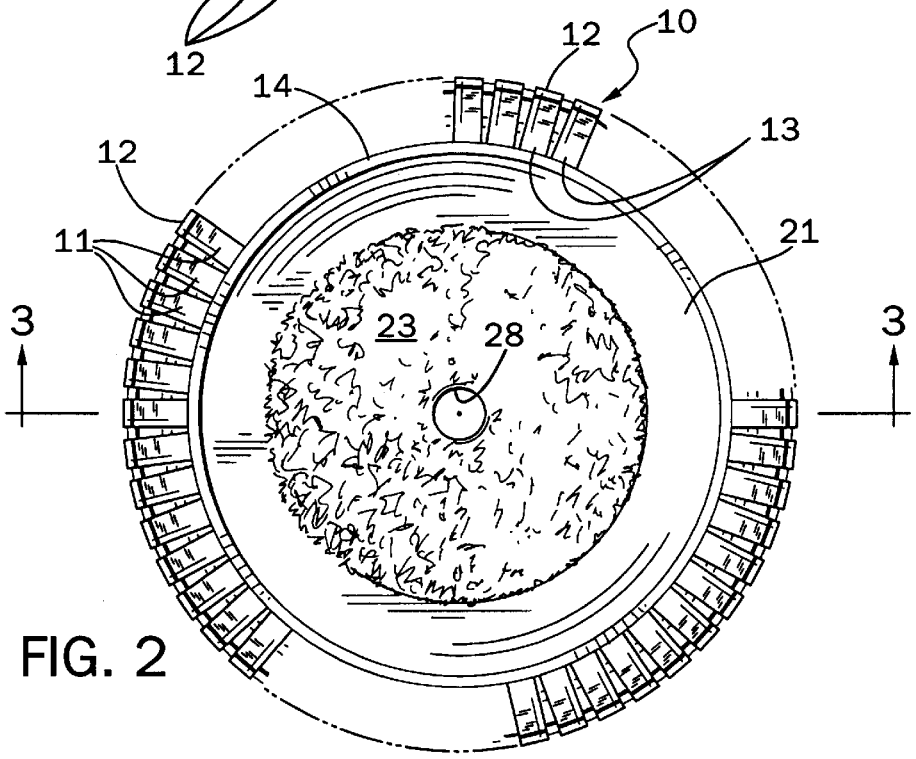
FIG. 2 is a bottom plan view of the finishing pad shown in FIG. 1.

FIG. 1 shows a polymeric foam pad 10 adapted to be used as a buffing or surface finishing pad, such as for automotive paint surface finishing. The pad is comprised of a large number of relatively closely packed foam fingers 11, the individual outer tips 12 of which form the primary active finishing surface of the pad. The base ends 13 of the fingers 11 are attached to a pad substrate 14, as may be seen in the backside view in FIG. 2. The fingers 11 may be formed and attached to the substrate 14 in a number of different ways, as will be described hereinafter. The polymeric foam material is typical of that commonly used in paint finishing pads and may comprise, for example, an open cell polyurethane which may be reticulated or unreticulated. A characteristic difference between finishing pads of the present invention and pads of the prior art is that the pads of this invention are not in the form of a single monolithic layer of foam, but rather are comprised of a dense array of individual fingers.

Figure 3:
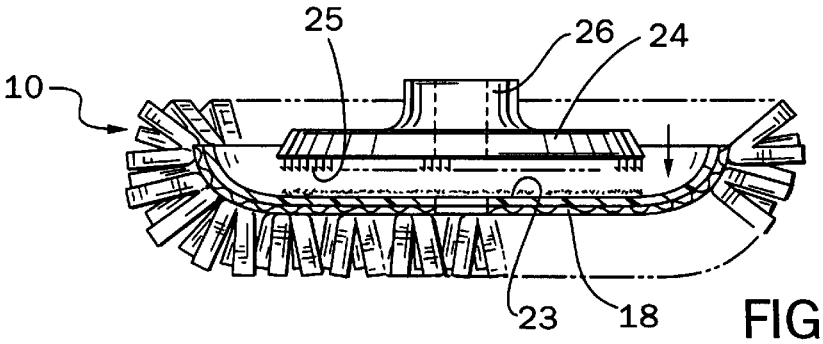
FIG. 3 is a vertical section taken on line 3—3 of FIG. 2 and additionally showing a backing plate.

Finishing pads of the subject invention may be made of either curved or flat construction, both of which are well known in the art. A curved pad is one in which the substrate is formed with a curved outer edge so that the foam wraps around and forms a laterally projecting peripheral buffing or finishing surface, such as shown in FIG. 3. As the name suggests, flat pads simply have a flat substrate, although the surface of the foam pad may be suitably contoured as desired.

Figure 5A:
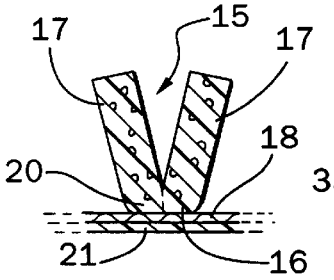
FIGS. 5A and 5B are sectional details showing alternate attachment mechanisms for the polymeric foam strip used to make pads of the present invention.
Figure 6A:
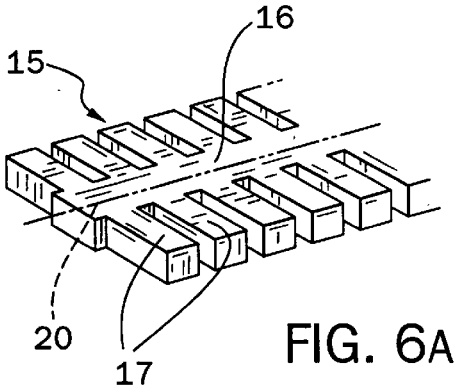
FIG. 6A is a perspective view of a section of the polymeric foam strip of FIGS. 5A and 5B.
Figure 6B:
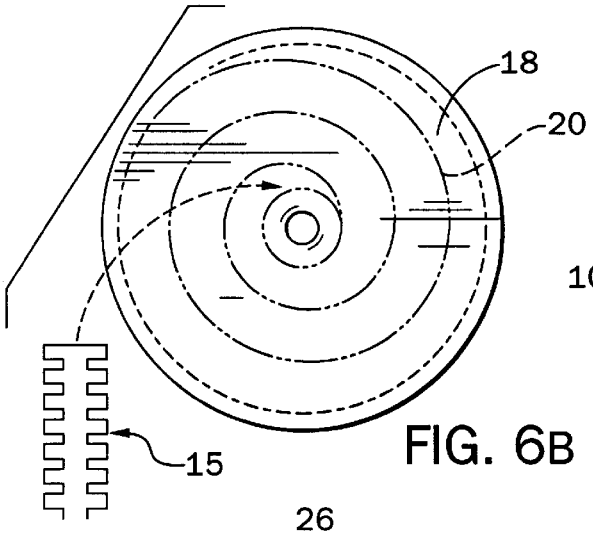
FIG. 6B–6E are generally schematic representations of the method for making the finishing pad shown in FIGS. 1–3.
Figure 6C:
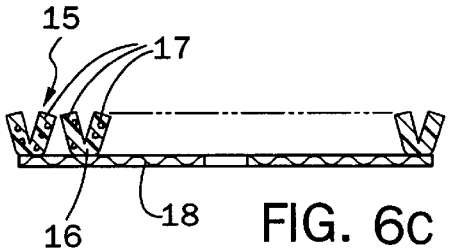

The pad shown in section in FIG. 3 may be manufactured in accordance with one presently preferred method which will be described with respect to FIGS. 6A–6E. A long continuous strip 15 of a suitable foam material is formed, as for example in a rotary die cutter, with an elongate body 16 and a series of integral laterally projecting and longitudinally spaced fingers 17. The strip 15 is sewn to a fabric substrate 18 which, conveniently, may comprise a conventional burlap or jute backing commonly used in the manufacture of tufted wool buffing pads. The strip 15 is sewn to the substrate 18 on a spiral stitch line 20 which extends longitudinally along the body 16 of the strip. The compression of the body 16 along the stitch line 20 causes the fingers 17 to turn upwardly, as shown in FIGS. 5A and 6C. Conveniently, stitching may commence at the radial outer edge of the substrate and spiral inwardly to the end of the strip 15 near the center of the substrate, as may best be seen with reference to FIG. 6B.

Figure 6D:
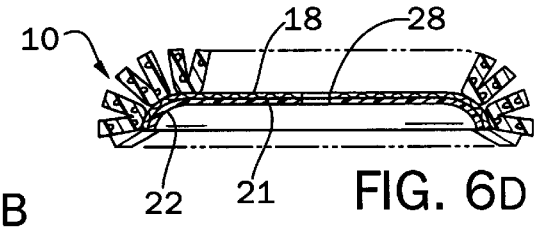
Figure 6E:
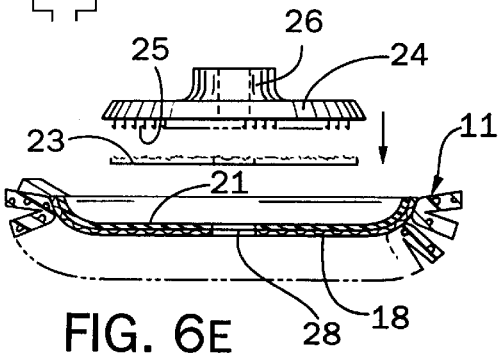

The flat fabric substrate 18 having the foam strip sewn thereto, as shown in FIG. 6C, may then be processed in a number of different ways to provide the unique foam fingered pad of the present invention. Referring also to FIGS. 6D and 6E, the substrate 18 may be curved by heat forming the back face of the substrate to a plastic backing 21 in a suitably shaped mold to provide an upturned peripheral edge 22 on the pad. In addition to the use of a woven natural fiber for the substrate 18, the substrate may also be made from woven synthetic fibers, woven fibers (either natural or synthetic) which are impregnated with a plastic, or solid plastic.

Figure 4:
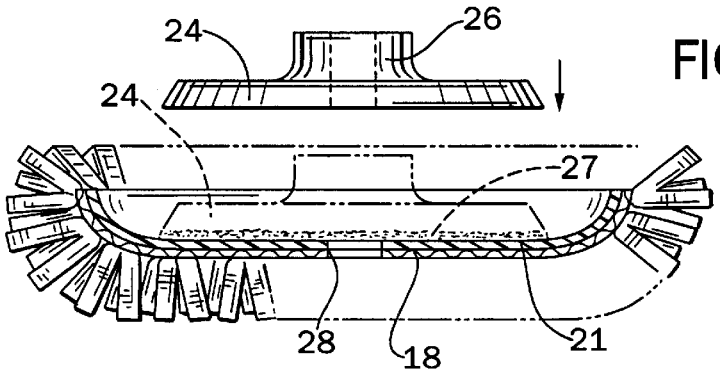
FIG. 4 is a view similar to FIG. 3 showing an alternate backing plate attachment.

The pad 10 may then be mounted on a buffing machine in any of several alternate ways. As shown in FIG. 6E and in FIG. 3, a sheet 23 of loop material, for a conventional hook and loop type fastening system, may be bonded or otherwise adhesively attached to the exposed face of the plastic backing 21. The loop material sheet 23 then cooperates with a conventional backing plate 24 to the face of which is attached a sheet 25 of hook material to cooperate with the loop material sheet 23 in a known manner. The backing plate 24 includes a central hub 26 which is internally threaded for attachment to the rotary stub shaft of a conventional buffing machine (not shown). Alternately, as shown in FIG. 4, the backing plate 24 may be bonded directly to the plastic backing 21 with a suitable adhesive layer 27. In a further alternate means for mounting, the fabric substrate and plastic backing 21 may be provided with a central hole 28 for receipt of the rotary buffing machine shaft for direct bolted mounting thereto, using a nut and washer (not shown) attached from the front face of the pad 10.

Figure 5B:
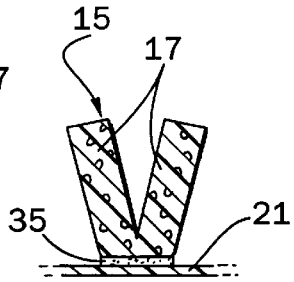

In FIG. 5B, an alternate means for attaching the foam strip 15 to a substrate is shown. By adhesively bonding the body 16 of the strip directly to a rigid plastic backing, as with a glue line 35, an intermediate fabric substrate may be eliminated. In lieu of a glued connection, alternate methods of attaching the foam strip 15 to the plastic backing 21 may include sonic welding or solvent bonding.

Figure 7:
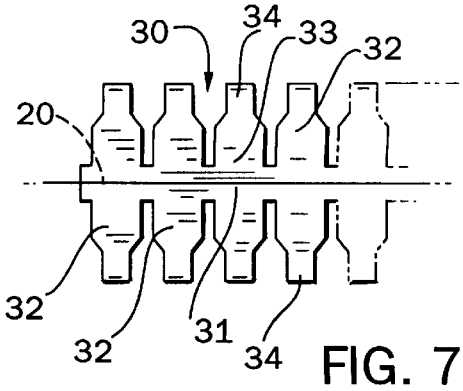
FIG. 7 is a top plan view of an alternate form of the polymeric foam strip used in making finishing pads of the subject invention.

As shown in FIG. 7, an alternate foam strip 30 includes a similar elongate body 31 running the full length of the strip, as in strip 15 of the previously described embodiment. The fingers 32, however, are formed somewhat differently, having a stepped configuration with wider base portions integrally attached to the body 31 and narrower outer ends 34 which define the working tips in the completed pad, as described above. The finishing pad of the present invention lends itself to use of a wide range of sizes and shapes of foam strips which may be readily custom cut for a particular application.

Figure 8:
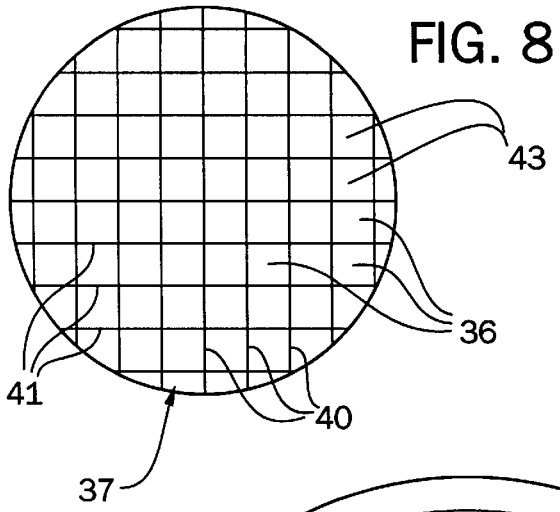
FIG. 8 is a top plan view of a finishing pad in accordance with another embodiment of the invention.
Figure 9:
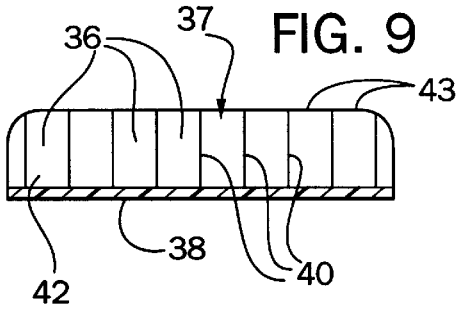
FIG. 9 is a side elevation view of the pad shown in FIG. 8.

Referring to FIGS. 8 and 9, there is shown an alternate construction in which foam fingers 36 are formed in a conventional polyurethane or other foam pad body 37. Thus, an open cell polyurethane foam pad body 37 of conventional construction is attached to a suitable substrate 38 which may, for example, be a plastic backing similar to that previously described. After attachment of the pad body to the substrate, the pad is cut on sets of mutually perpendicular first slit lines 40 and second slit lines 41. Preferably, the slit lines 40 and 41 extend completely through the pad body 37 all the way to the substrate 38. The resulting pad comprises a plurality of fingers 36 disposed in a dense array and having their individual base ends 42 attached to the substrate 38 and their outer tips 43 defining the pad finishing face 43. Some or all of either group of slit lines 40 and 41 may extend only partially into the pad body 37 less than the full thickness thereof.

Figure 10:
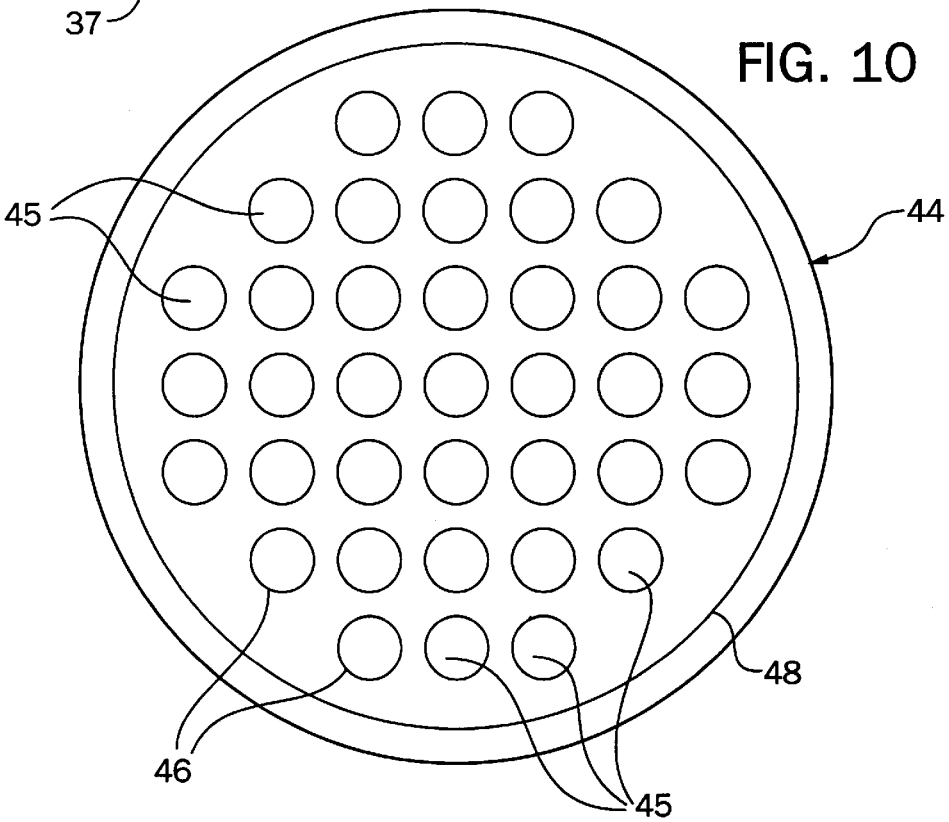
FIG. 10 is a top plan view of a pad showing a further embodiment of the present invention.
Figure 11:
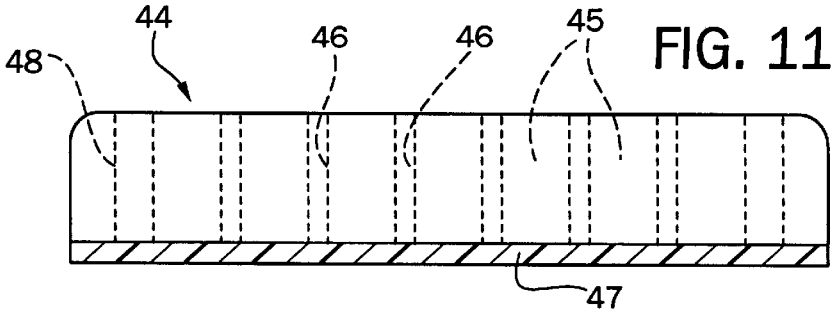
FIG. 11 is a side elevation of the pad shown in FIG. 10.

Referring now to FIGS. 10 and 11, a conventional flat faced circular pad body 44, similar to the body 37 of the previously described embodiment, may have a pattern of fingers 45 slit therein which is substantially different from the fingers 36 of FIGS. 8 and 9. In this embodiment, the fingers 45 comprise cylindrical bodies 46 which are individually cut through the foam body 44 generally perpendicular to the pad substrate 47. The pattern as well as the shape and size of the fingers 45 may be varied considerably, as desired for changing the buffing characteristics of the pad. In the particular construction shown in FIG. 10, the pad is provided with a large circular slit 48 near the outer periphery. This has been found to add to the pad flexibility and to also provide an outer containment ring to reduce splatter of finishing compound. As with the embodiment of FIGS. 8 and 9, the slit lines preferably extend the full depth of the pad body 44, but any or all of the slit lines may be limited to less than the full depth.

The foam fingers of any of the pad embodiments described above may have abrasive particles embedded therein or attached thereto to provide a more aggressive finishing pad. The abrasive particles may be attached to the tips of the fingers by an adhesive or some other bonding process, or the abrasive particles may be incorporated directly into the foam material when it is manufactured.

We claim:

1. A surface finishing pad comprising:

a substantially planar supporting substrate; and, plurality of fingers of a polymeric foam material disposed in a tightly packed dense array and having inner base ends compressively attached to the substrate to extend outwardly therefrom and having outer tips defining a pad finishing face.

2. The finishing pad as set forth in claim 1 and further comprising:

an elongate foam body to which the base ends of said fingers are integrally joined; and, means for securing said body along substantially its full length to the substrate.

3. The pad as set forth in claim 2 wherein said substrate is circular and said body is secured thereto along a spiral connecting line extending between an outer edge of the substrate and a central region of the substrate.

4. The pad as set forth in claim 3 wherein said connecting line is sewn.

5. The pad as set forth in claim 3 wherein said connecting line is glued.

6. The pad as set forth in claim 3 wherein said connecting line is fused.

7. The finishing pad as set forth in claim 3 wherein the substrate is made from a material selected from the group consisting of woven natural fiber, woven synthetic fiber, plastic impregnated woven fiber, and solid plastic.

8. The finishing pad as set forth in claim 3 wherein said body and integral fingers are made from a thin strip of foam formed with a central body portion extending generally along the centerline of said strip and a plurality of finger portions extending laterally from said body portion in opposite directions.

9. The finishing pad as set forth in claim 1 wherein said fingers are glued to said substrate.

10. The finishing pad as set forth in claim 1 wherein said fingers are fused to said substrate.

11. The finishing pad as set forth in claim 1 wherein said polymeric foam material comprises polyurethane.

12. The finishing pad as set forth in claim 11 wherein the polymeric foam material comprises open cell polyurethane.

13. The finishing pad as set forth in claim 11 wherein the polymeric foam material comprises reticulated open cell polyurethane.

14. The finishing pad as set forth in claim 1 wherein the outer tips of said fingers are loaded with abrasive particles.

15. The pad as set forth in claim 14 wherein said abrasive particles are adhesively attached to said fingers.

16. The pad as set forth in claim 14 wherein said abrasive particles are incorporated into the foam material.

17. A surface finishing pad comprising:

a support substrate;

a strip of polymeric foam material having an elongate body and a plurality of fingers extending from the body to outer tips; and means for attaching the body of the strip to the substrate along a substantially continuous seam to define laterally adjacent body portions and finishing face comprised of the tips of said fingers.

18. The finishing pad as set forth in claim 17 wherein the substantially continuous seam for attaching the strip to the substrate is selected from the group consisting of sewn, glued, and fused.

19. The finishing pad as set forth in claim 17 wherein said substrate is generally circular in shape and wherein said seam is in the form of a spiral.

* * * * *